United States Patent [19]

Robbins

[11] Patent Number: 4,685,585

[45] Date of Patent: Aug. 11, 1987

[54] DOUBLE WALL TANK MANWAY SYSTEM

[76] Inventor: Howard J. Robbins, 8561 El Paseo Grande, La Jolla, Calif. 92037

[21] Appl. No.: 917,028

[22] Filed: Oct. 9, 1986

[51] Int. Cl.[4] ..... B65D 51/18

[52] U.S. Cl. ..... 220/256; 220/465; 220/5 A

[58] Field of Search ..... 220/5 A, 256, 258, 465, 220/469

[56] References Cited

U.S. PATENT DOCUMENTS 2,014,861 9/1935 Neely ..... 220/259

3,848,765 11/1974 Durkop ..... 220/256

*Primary Examiner*—George T. Hall

*Attorney, Agent, or Firm*—Albert L. Gabriel

[57] ABSTRACT

A double wall manway assembly for double wall tanks intended primarily for underground use, wherein an inner wall provides primary fluid containment and an outer wall provides secondary fluid containment, and a monitor between the walls can detect leakage past the inner wall into the space between the walls. The double wall manway assemby of the invention includes a riser conduit extending through apertures in the two tank walls and having an in-turned inner flange and an out-turned outer flange, with inner and outer cover members removably sealingly engaged over the respective inner and outer flanges. The space within the riser between the two covers communicates with the space between the two tank walls through one or more vent holes through the wall of the riser, for conducting any fluid leakage through the inner cover flange seal to the monitor between the tank walls. In some forms of the invention, a plurality of pipe fittings are embodied in the double wall manway as structural parts thereof.

20 Claims, 13 Drawing Figures

DOUBLE WALL TANK MANWAY SYSTEM

BACKGROUND OF THE INVENTION

1. Field of the Invention

The invention is in the field of tanks, principally for underground fluid storage, and is particularly directed to such tanks which are of double wall construction.

2. Description of the Prior Art

Regulations in many states, and of the U.S. federal government currently require double wall construction for underground fluid storage tanks because of environmental considerations. Such double wall tank construction constitutes, in effect, an inner tank supported within an outer tank. The inner tank defines the primary, inner chamber which provides primary containment for fluid being stored, while the space defined between the inner and outer tanks defines an outer, secondary chamber which provides for secondary containment of the fluid in the event a leak should develop through the wall of the inner tank, as for example from corrosion, a faulty weld, or seismic or other mechanical stressing. One or more monitors are conventionally located in communication with the outer, secondary chamber between the two tanks, and any leakage from the inner tank into this outer, secondary chamber is directed toward one or more of such monitors which then provide an alarm signal indicating the leakage.

There are several different grades and types of underground storage tanks generally considered to be of double wall construction currently in use in the United States, and these are almost all of cylindrical construction and are layed on their side underground, i.e., have their cylindrical axes disposed generally horizontally. A full double wall tank with two complete cylindrical tanks, one inside the other, is designated a "Type Two" double wall tank. This has double end walls and 360° double cylindrical wall protection. Another type of tank commonly referred to as a double wall tank is a "Type One" tank, commonly known as a "wrap tank." Here, the primary tank is cylindrical, with an outer sheet provided which gives double wall protection for approximately 330° around the lower part of the tank, leaving the top part of the tank with only the single wall protection of the primary tank. The Type One wrap tank is utilized with the consideration that the greatest potential for failure of the primary tank is in its lower part, with a relatively small potential for failure at its top. While regulations of some states still allow use of the Type One wrap tank as a double wall tank, other, more progressive states such as California require the Type Two full double wall tank.

All underground storage tanks require access pipe fittings which extend through the top of the tank from the outside into the primary containment chamber within the tank. Typically for the storage of fuels such as gasoline and diesel fuel there are at least five such fittings required, a fill fitting, a turbine fitting for fuel extraction, a fitting for gauging, a vent fitting, and a vapor recovery fitting. The Type One wrap tank is a metal tank, and for such tanks the pipe fittings are conveniently welded into the single wall at the top of the tank. For a Type Two full double wall metal tank, the fittings conventionally extend through both walls at the top of the tank, being welded to both the outer and inner tanks.

However, many tanks which are considered full double wall tanks are currently being produced that are nonmetallic, having a wound filament fiberglass/resin construction. This filament winding fabrication process does not permit fittings to be integrally incorporated in a double wall nonmetallic tank when the two walls are being fabricated, and if the fittings are to be disposed directly through the two walls of the nonmetallic double wall tank, then it is necessary to drill holes through the two walls and bond the fittings to the walls from both sides, which is costly, difficult and unreliable. Therefore, for nonmetallic double wall tanks, the almost universal current procedure is to provide manway openings, and to provide metal covers for such openings through which the pipe fittings are welded. Only three fittings can be accommodated in a single manway cover, so where more than three fittings are required, which is usually the case, two manways and associated metal covers with fittings are conventionally provided with nonmetallic tanks.

For this reason, manways are currently employed in all filament-wound double wall nonmetallic tanks. Manways are also required for double wall metal tanks where interior servicing will be necessary during use of the tanks, as for example where frequent cleaning is required as in jet fuel tanks, where special materials are to be held in the tank, such as distilled water, or certain chemicals, and it is necessary to get inside the tank after it is completed to apply lining material within the tank, or in some cases where bladders are installed internally within the tanks after the tanks have been constructed to enable positive expulsion of tank contents by pressurization between the tank walls and bladder.

Prior to the present invention, manway covers for such double wall metal tanks requiring manways, as well as the aforesaid metal manway covers with fittings for fiberglass tanks, have conventionally been of single wall construction. Thus, although the tank itself might otherwise comply with regulations calling for a Type Two full double wall tank, whether it be of metal or fiberglass, with prior art double wall tanks there still remained only single wall containment at the manway or manways. Should a leak occur in the seal of such a single manway cover, such leak might go undected for an extended period of time, since it could not possibly be detected by a monitor or monitors located between the inner and outer walls of the tank, and being underground it would not be observable from the surface unless it became so serious as to cause earth movement. Although current governmental regulations do not point directly to manway covers in calling for Type Two full double wall tanks, because of the danger of only single wall containment at manway covers, it is contemplated that future regulations will require complete double wall containment at all points or regions on tanks, even at the manways.

SUMMARY OF THE INVENTION

In view of these and other problems in the art, it is a general object of the present invention to provide a double wall tank construction which provides complete double wall containment of fluid contents at all points or regions of the tank.

Another general object of the invention is to provide a double wall tank construction wherein one or more monitors located between the walls of the tank can detect leakage from the primary containment chamber of the tank at any point or region of the tank, even at or proximate one or more manway covers.

Another object of the invention is to provide a tank manway system of double wall construction which will complete the double wall containment of an otherwise full double wall tank of Type Two construction.

Another object of the invention is to provide a double wall manway system wherein an inner cover or wall member is in sealed association with the inner, primary containment wall of a double wall tank, and an outer cover or wall member is in sealed association with the outer, secondary containment wall of the double wall tank, whereby the entire extent of each of the inner and outer walls of the tank is sealed, providing 100© primary and secondary containment for fluid contents of the tank.

A further object of the invention is to provide a double wall tank manway construction wherein two walls or covers which afford double wall containment at the manway are easily removable to provide access to the interior of the tank, and then easily replaceable to provide sealed double wall containment for the tank.

A still further object of the invention is to provide a double wall manway system which embodies tank pipe fittings as structural parts of the double wall manway cover assembly, and to provide for adjustment or accommodation of the spacing between the two walls or covers of such manway cover assembly to enable positive seating and sealing of the peripheries of the manway walls or covers against respective seats on the manway structure.

An additional object of the invention is to provide, in a double wall tank, a double wall manway assembly which provides communication from the space between the two walls or covers of the manway assembly and the space between the two walls of the tank, whereby any leakage through the region of the inner manway wall or cover seal will be communicated to the region between the two tank walls, and hence to one or more monitors disposed in the region between the two tank walls.

The double wall manway system of the invention embodies as its base or mounting structure a manway riser which extends through registering apertures in the two walls of a double wall tank and is sealingly connected to each of the tank walls, as by welding. The riser has an in-turned inner flange located proximate or inwardly of the inner wall of the tank, and an out-turned outer flange located externally of the outer wall of the tank. An inner wall or cover member is seated on the inner flange in sealing engagement therewith, being clamped into position by an annular series of studs and stud nuts, while an outer wall or cover is sealingly engaged over the outer flange, being clamped thereto by a peripheral array or bolts or studs and nuts. The space or chamber within the manway assembly defined within the riser and between the inner and outer wall or cover members communicates with the space between the two tank walls through one or more vent holes extending through the wall of the riser. With such communication, any leak that may develop in the peripheral seal of the inner wall or cover member against the inner flange will be communicated through the vent hole or holes to the space between the tank walls, and thence to one or more monitors located between the tank walls.

In some forms of the invention, a plurality of pipe fittings, preferably three, is embodied in the double wall manway assembly as a structural part thereof. Such pipe fittings extend through both walls or covers of the manway assembly, providing communication from the outside of the tank to the primary inner chamber of the tank contained within the inner tank wall. The pipe fittings are sealingly connected to both of the inner and outer walls or covers of the double wall manway assembly. In one form of double wall manway assembly having pipe fittings according to the invention, the pipe fittings are welded to the inner wall or cover of the assembly, and extend through registering apertures in the outer wall or cover of the assembly, with external pipe fitting nuts threadedly engaged about the upper end portions of the fittings above the upper wall or cover, and clamped down against the upper wall or cover member in sealing engagement therewith, providing a bulkhead-type fitting. This arrangement allows for automatic adjustment of the spacing between the inner and outer wall or cover members of the assembly to assure positive peripheral sealing of the wall or cover members against their respective flanges on the riser.

In another form of double wall manway assembly embodying pipe fittings as structural parts thereof, the fittings are welded to both of the inner and outer walls or covers of the assembly, providing a unitary double wall cover assembly. In this form of the invention, an annular series of holes through the upper wall or cover of the assembly provides access for a wrench with captive nuts for clamping the inner wall or cover to the inner flange of the riser. In this form of the invention, accurate spacing during manufacture between the inner and outer walls or covers of the assembly will permit positive sealing of the covers against their respective flanges, or alternatively, one or more shims may be provided in the region of the seal or seals between the covers and flanges to accommodate any tolerance variation.

In a further double wall manway assembly embodying pipe fittings according to the invention, the fittings have conventional inner and outer end pipe sections welded to the respective inner and outer walls or covers of the assembly, but have intermediate bellows sections located bewteen the inner and outer walls or covers which provide automatic adjustment of the spacing between the inner and outer walls or covers for positive peripheral sealing against their respective flanges.

BRIEF DESCRIPTION OF THE DRAWINGS

These and other objects and advantages of the present invention will become more apparent from the following detailed description taken in conjunction with the drawings, wherein.

DETAILED DESCRIPTION

Figure 1:
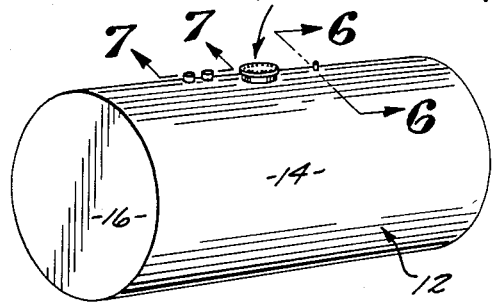
FIG. 1 is a perspective view of a cylindrical tank embodying a first form of double wall manway assembly according to the invention.

FIGS. 1-5 and 8 illustrate one form of double wall manway assembly according to the invention, which is generally designated 10. Double wall manway assembly 10 is embodied in a double wall tank generally designated 12, conventionally of cylindrical configuration. Tank 12 thus has cylindrical body 14, and end closures 16. The double wall tank 12 actually consists of an outer tank and an inner tank which is closely spaced within the outer tank, with a double, parallel wall construction in both the cylindrical body 14 and the end closures 16. Double wall manway 10 is disposed through the cylindrical body portion 14 of tank 12, and hence the outer and inner walls 18 and 20, respectively, of cylindrical tank body 14 are illustrated in the drawings in cooperation with double wall manway 10. Inner cylindrical wall 20 of tank 12 defines the inner or primary chamber 22 of tank 12, while the space between outer and inner cylindrical walls 18 and 20, respectively, constitutes the outer or secondary chamber 24 of tank 12.

Double wall manway assembly 10 has as its primary structural base a cylindrical riser 26 defining a manway conduit 27, riser 26 extending through both of the outer and inner tank walls 18 and 20, respectively, so that manway conduit 27 communicates at its inner end with the inner chamber 22 of tank 12, and at its outer end with the atmosphere externally of outer tank wall 18. Riser 26 extends through complementary circular apertures 28 and 30 in respective outer and inner tank walls 18 and 20, being secured and sealed to outer wall 18 by an annular external weld 32, and being secured and sealed to inner wall 20 by an annular internal weld 34. Weld 32 is made from outside the tank, while weld 34 is made from inside the tank. The cylindrical riser 26 is preferably diametrically oriented relative to tank 12.

Manway riser 26 has an integral inner flange 36 extending radially inwardly from its lower edge. Inner flange 36 is a flat, annular, in-turned or "inverse" flange, and in practice it will normally be annularly welded to the lower edge of riser 26 so as to form an integral part with riser 26. Inner flange 36 is preferably disposed below or inside of the inner tank wall 20, but it need not be, provided inner flange 36 is spaced downwardly or inwardly from outer tank wall 18 so that one or more vent passages extending through the wall of riser 26 can provide communication from inside riser 26 above inner flange 36 to outer secondary tank chamber 24 as described in detail hereinafter. An outer flange 38 extends radially outwardly from the upper edge of riser 26 externally of outer tank wall 18, outer flange 38 being a flat, annular, out-turned flange which is integrally secured to the upper or outer edge of riser 26, preferably by annular welding. The connections of flanges 36 and 38 to riser 26 are fluid-tight.

Inner flange 36 has an annular array of regularly spaced studs 40 integrally secured to inner flange 36 as by welding, and projecting upwardly from the upper surface of inner flange 36. Stud nuts 42 are threadedly engageable over the exposed upper ends of inner flange studs 40. Outer flange 38 is provided with an annular array of regularly spaced bolt holes 44.

An inner cover disk 46 is provided with a radial dimension slightly less than the radial dimension of manway conduit 27 so that it can be moved downwardly or inwardly through manway conduit 27 into overlapping relationship with inner flange 36. Inner cover disk 46 has an annular array of regularly spaced stud holes 48 therethrough which register with the respective inner flange studs 40. An inner sealing gasket 50, which is a flat, annular gasket of sealing material, is radially dimensioned so as to overlie inner gasket 36, and also has an annular array of regularly spaced holes therethrough which register with inner flange studs 40. The first assembly step in covering and sealing the double wall manway assembly 10 is to lay sealing gasket 50 flush against the upper surface of inner flange 36, with studs 40 projecting upwardly through the registering holes in gasket 50, and then seating inner cover disk 46 over gasket 50 with studs 40 projecting upwardly through the respective stud holes 48 in inner cover 46. Then, stud nuts 42 are engaged with studs 40 and tightened so as to clamp inner cover disk 46 tightly down against gasket 50.

An outer cover disk 52 is provided which is radially coextensive with the outer edge of outer flange 38, and which has an annular array of regularly spaced bolt holes 54 which register with the respective outer flange bolt holes 44. An outer sealing gasket 56 is coextensive with the upper surface of outer flange 38, being a flat, annular sheet of sealing material. Outer gasket 56 has an annular array of regularly spaced holes therethrough which register with outer flange bolt holes 44 and outer cover bolt holes 54. Assembly of double wall manway structure 10 is completed by laying outer gasket 56 over the upper surface of outer flange 38 with the gasket holes registering with flange bolt holes 44, and then laying outer cover disk 52 over gasket 56 with cover holes 54 also in registry with outer flange holes 44, and then disposing an annu nuts so as to clamp outer cover disk 52 tightly down against gasket 56 and flange 38.

If desired, bolts 58 may be replaced by studs extending upwardly from integral connections with outer flange 38 in registry with the annular array of holes 54 through outer cover 52, with a series of nuts being threadedly engageable with such studs above outer cover 52.

Figure 2:
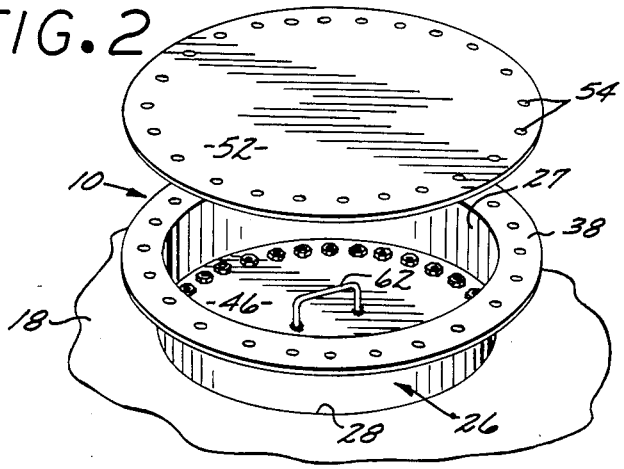
FIG. 2 is an exploded view of the double wall manway assembly of FIG. 1, with the attachment bolts and nuts removed from the outer manway cover and flange.
Figure 3:
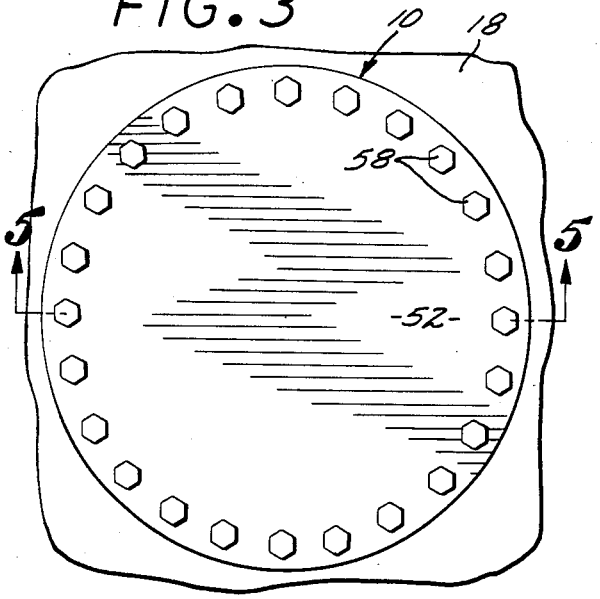
FIG. 3 is a top plan view of the double wall manway assembly shown in FIGS. 1 and 2.
Figure 4:
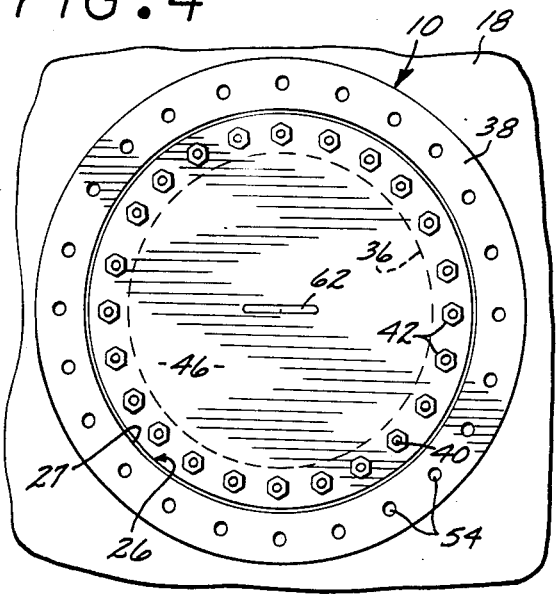
FIG. 4 is a top plan view of the double wall manway assembly of FIGS. 1–3, with the outer cover and its attachment bolts and nuts removed.
Figure 5:
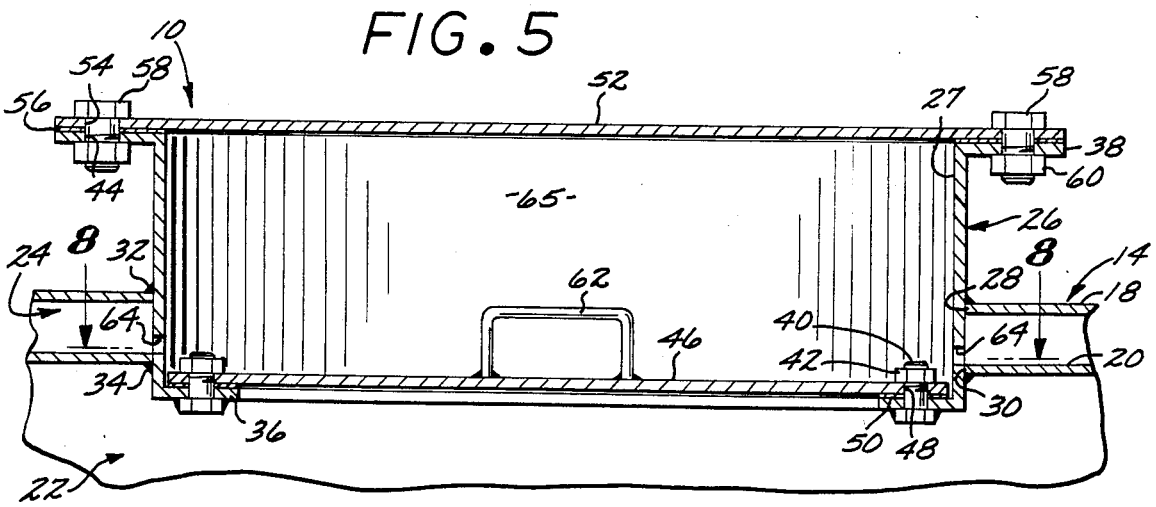
FIG. 5 is a vertical axial, diametrical section, partly in elevation, taken on the line 5—5 in FIG. 3, illustrating details of construction of the first form of the invention which is shown in FIGS. 1–4.

In order to facilitate assembly of inner cover disk 46 down into the bottom of manway riser 26, it is preferred to provide an upwardly extending integral handle 62 on inner cover 46, as best seen in FIGS. 2 and 5.

A pair of diametrically opposed vent holes 64 is provided through the wall of cylindrical riser 26 providing communication between the inside of riser 26 and the outer or secondary chamber 24 between tank walls 18 and 20. Preferably, vent holes 64 communicate with secondary chamber 24 close to the inner tank wall 20. The purpose of vent holes 64 is to enable detection of a leak past inner gasket 50. One or more monitor sensors are conventionally provided in the outer or secondary chamber of a double wall tank, and any leak through the region of inner gasket 50 will be communicated from inner, primary chamber 22 of tank 12 into the manway chamber 65 between covers 46 and 52, and thence through vent holes 64 to be detected by the monitor or monitors located within outer, secondary tank chamber 24.

Figure 6:
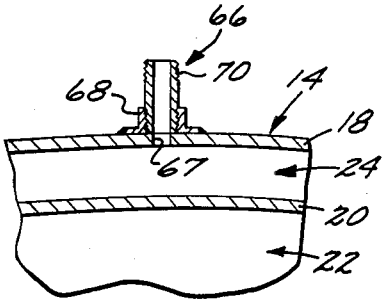
FIG. 6 is a transverse vertical section taken on the line 6—6 in FIG. 1, illustrating access structure providing access from outside the tank to the space between the outer and inner walls of the tank.

FIG. 6 illustrates access structure, generally designated 66, providing access from the outside of tank 12 through outer tank wall 18 to outer, secondary tank chamber 24 for monitoring purposes. Access structure 66 is spaced on tank 12 from the double wall manway assembly 10 as indicated in FIG. 1, and includes an access port 67 through outer tank wall 18 providing communication with outer, secondary tank chamber 24. An external access fitting 68 is attached to outer tank wall 18 as by welding, and receives an external pipe nipple 70 to which a vacuum sensor may be connected, or through which conductor means may be passed to an electronic or other sensor means constituting the monitor or monitors located within outer, secondary tank chamber 24.

Figure 7:
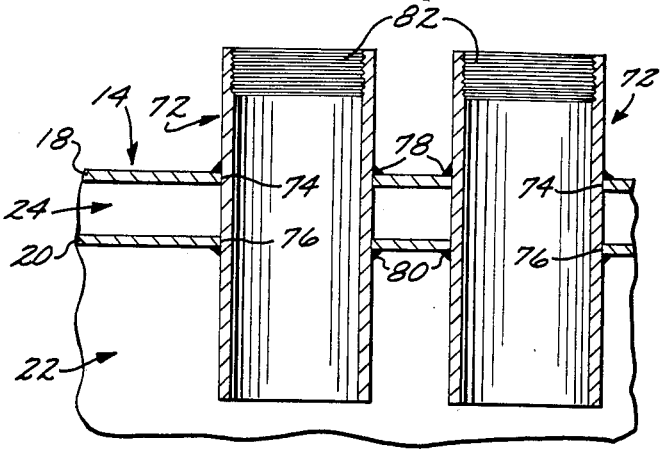
FIG. 7 is an axial, vertical section taken on the line 7—7 in FIG. 1 illustrating a pair of pipe fittings which extend through the outer and inner walls of the tank.
Figure 8:
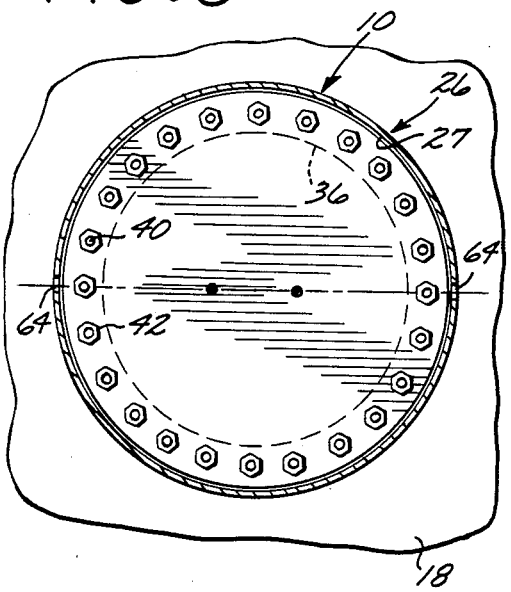
FIG. 8 is a horizontal, transverse section taken on the line 8—8 in FIG. 5.

In some tank applications, pipe fittings are required which extend from outside of the tank to the inner, primary chamber of the tank. Typically, as many as five such tank fittings are required, (1) a fill fitting, (2) a turbine fitting for fluid extraction, (3) a fitting for gauging, (4) a vapor recovery fitting, and (5) a vent fitting. Such pipe fittings are conventionally of relatively large diameter, having 4-inch diameter internal threads in the upper end portion. A plurality of such pipe fittings is made a part of the present double wall manway assembly invention in the forms of the invention shown in FIGS. 9–13. However, it is only practical to embody three such pipe fittings in double wall manway assemblies according to the invention, and if additional pipe fittings are desired, these may be provided through the walls of the tank at locations spaced from the double wall manway assembly, if the tank walls are metal. Thus, where three such pipe fittings are embodied in the double wall manway assembly of the invention, typically a pair of additional pipe fittings will be spaced along the tank as illustrated in FIG. 1, and as shown in detail in FIG. 7. Referring to FIG. 7, the two pipe fittings are each generally designated 72, and they each extend through a pair of radially aligned holes 74 and 76 through the respective outer and inner tank walls 18 and 20. Each of the pipe fittings 72 is rigidly secured and sealed with respect to outer tank wall 18 by an annular external weld 78, and to inner tank body 20 by an inner annular weld 80. Each of the pipe fittings 72 has an internally threaded upper end section 82, typically with 4-inch ID threading. Thus, pipe fittings 72 each provide communication from externally of the tank through both of the tank walls 18 and 20 to the inner, primary tank chamber 22, while at the same time provide a strong, stable pipe connection.

It is desirable to test the integrity of all welds and seals forming a part of the double wall manway assembly installation in tank 12. The welded connections of respective inner and outer flanges 36 and 38 to manway riser 26 are most easily tested before riser 26 is installed in the tank. Such testing may be accomplished by attaching the inner and outer covers 46 and 52 to the respective inner and outer flanges 36 and 38 with the respective sealing gaskets 50 and 56 in place as best illustrated in FIG. 5, and then air-testing the integrity of this assembly by either vacuum or pressure applied through one of the vent holes 64, with the other vent hole 64 plugged. Annular welds 32 and 34 connecting riser 26 to respective outer and inner tank walls 18 and 20 may be air-tested by vacuum or pressure applied to outer, secondary tank chamber 24, as for example through the access structure 66 of FIG. 6. This is preferably done with vent holes 64 plugged, without need to have the covers and their gaskets in place. However, this may alternatively be done with the two covers and their gaskets seated in place as shown in FIG. 5, without plugging vent holes 64.

It is not important to have a tight seal between outer cover 52 and outer flange 38, since the primary purpose of the double wall tank system is for secondary containment of the fluid contained in inner, primary chamber 22, and monitoring of the primary containment within inner, primary chamber 22. However, it is important to have a tight seal for the primary containment of inner cover 46 against inner flange 36. Accordingly, it is desirable to test the integrity of the seal provided by inner sealing gasket 50, and this can be done by soap sudsing around the periphery of inner cover 46 with outer cover 52 removed, and then pressurizing inner, primary tank 22, as for example through one of the pipe fittings 72.

Figure 9:
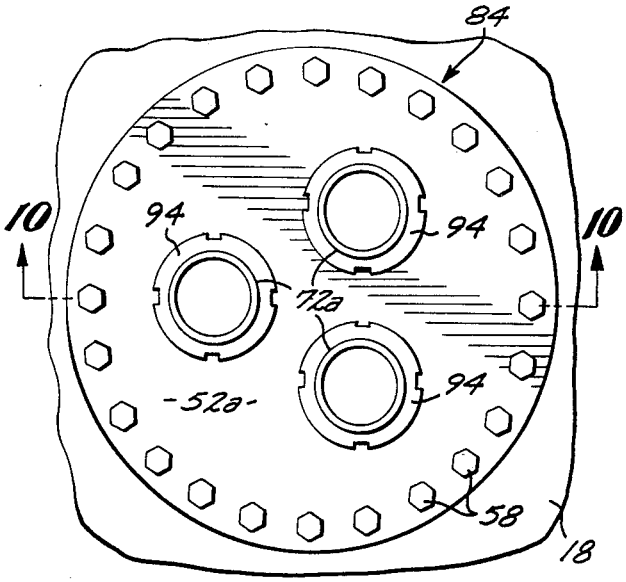
FIG. 9 is a top plan view showing a second form of the invention wherein three pipe fittings are embodied as structural parts of a double wall manway assembly according to the invention.
Figure 10:
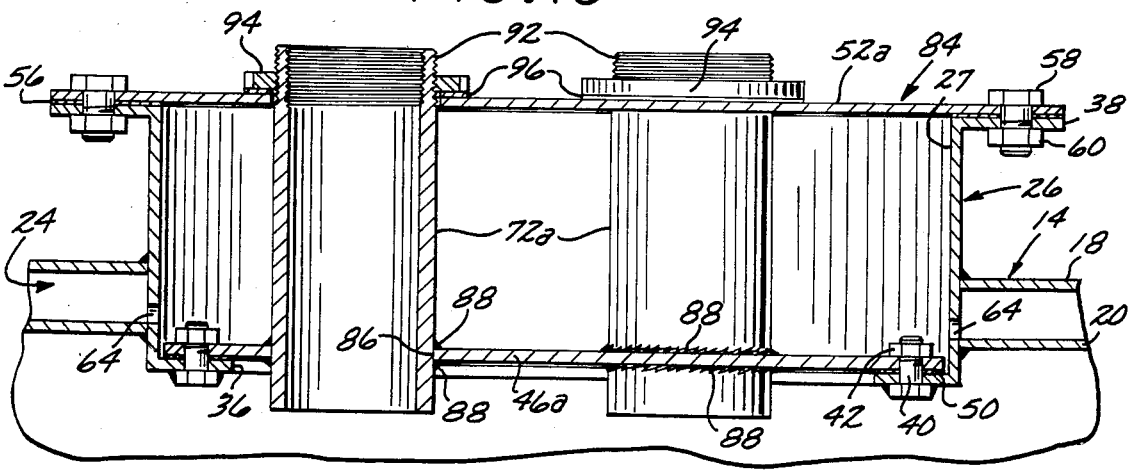
FIG. 10 is an axial, vertical section, partly in elevation, taken on line 10—10 in FIG. 9.

FIGS. 9 and 10 illustrate a second double wall manway assembly according to the invention, generally designated 84, which embodies three pipe fittings regularly spaced about the manway assembly 84. The three pipe fittings not only serve the pipe fitting function heretofore described, but provide direct interlocking or coupling between the inner and outer cover disks, serving as structural support portions of the manway assembly 84.

In the embodiment of FIGS. 9 and 10, manway riser 26, its inner and outer flanges 36 and 38, respectively, and the attachments and sealings between the inner and outer covers and the respective inner and outer flanges 36 and 38 are the same as for the first embodiment of the invention shown in FIGS. 1–5 and 8.

In the form of the invention shown in FIGS. 9 and 10, the inner and outer cover disks are respectively designated **46*a* and 52*a*, and these are identical to respective inner and outer cover disks 46 and 52 of the first form of the invention except for adaptation thereof to the three pipe fittings. The three pipe fittings are each designated 72*a*, and are of the same type as pipe fittings 72 shown in FIG. 7, except for an added externally threaded upper section. Three apertures 86 are provided through lower cover disk 46*a*, being regularly spaced about cover 46*a*, and the three pipe fittings 72*a* are fitted through these apertures 86 and integrally attached and sealed thereto, with their axes normal to the plane of inner cover 46*a*, by means of annular welds 88, preferably provided on both sides of inner cover 46*a*. Corresponding apertures 90 are provided through outer cover 52*a*, being slightly larger in diameter than the outer diameter of pipe fittings 72*a* for a sliding fit of pipe fittings 72*a* therethrough. Externally threaded sections 92 are provided at the upper ends of pipe fittings 72*a* to receive respective nuts 94**.

Assembly of the double wall manway 84 shown in FIGS. 9 and 10 is accomplished by first installing manway riser 26 in tank 12 in exactly the same manner as shown in FIGS. 1–5 and 8 and described in connection therewith. Then, inner sealing gasket 50 is layed over inner flange 36 and inner cover 46*a* with its integrally supported pipe fittings 72*a* is lowered through riser 26 with its periphery on top of gasket 50, and it is secured to inner flange 36 by studs 40 and stud nuts 42. Then outer gasket 56 is layed over outer flange 38, and outer cover 52*a* is lowered over the upper ends of pipe fittings 72*a*, with apertures 90 registering with the respective pipe fittings 72*a*, and peripheral bolts 58 and nuts 60 engaged to secure outer cover 52*a* in sealed position on outer flange 38. As before, studs and stud nuts may alternatively be employed instead of bolts 58 and nuts 60. Finally, annular sealing gaskets 96 are engaged over the upwardly projecting free ends of pipe fittings 72*a*, and nuts 94 threadedly engaged over the externally threaded sections 92 of fittings 72*a* and tightened down to provide a sealed engagement with outer cover 52*a* through sealing gaskets 96. The arrangement of pipe fittings 72*a* extending through outer cover 52*a*, with cover 52*a* clamped down and sealed by nuts 94 and gaskets 96, is generally referred to as a "bulkhead fitting."

If desired, the peripheral arrays of bolt holes 40 in outer flange 38 and 54 in outer cover 52*a* can be omitted from the form of the invention shown in FIGS. 9 and 10, and outer gasket 56 provided without the bolt holes, and in such case, the clamp-down force for outer cover 52*a* against outer flange 38 will be provided entirely by the threaded clamp-down force of nuts 94 through gaskets 96 against outer cover 52*a*. The large diameter (approximately 5-inch outer thread diameter of the externally threaded sections 92 of pipe fittings 72*a*) will provide adequate clamp-down force for most circumstances. For example, a 5-inch outer thread diameter for threaded sections 92 will give a 15.7 inch thread circumference for each of the three pipe fittings 72*a*, or a total of approximately 47 inches of thread circum-ference for the three pipe fittings 72*a*. By way of comparison, if outer cover 52*a* were directly threaded into a typically dimensioned 24-inch riser, that would provide approximately a 75-inch thread circumference, or only approximately 1.6 times the amount of thread circumference and clamp-down force.

Figure 11:
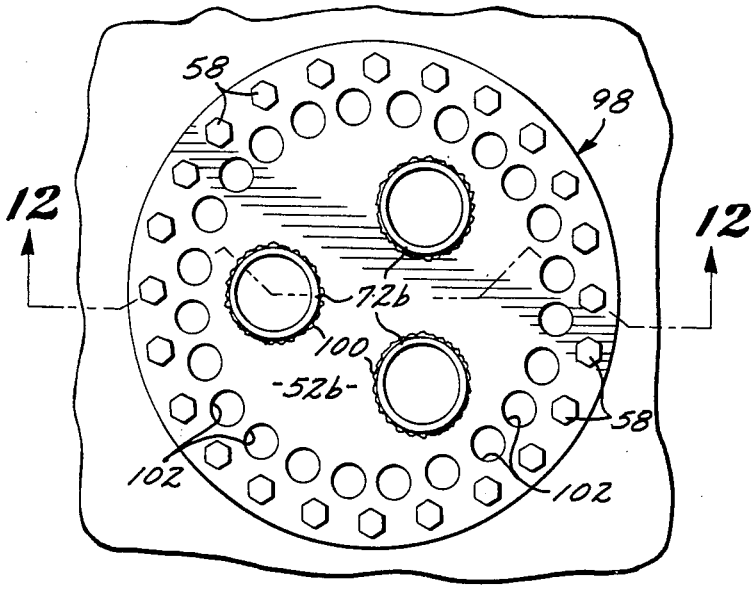
FIG. 11 is a top plan view similar to FIG. 9, but illustrating another form of the invention embodying three pipe fittings as structural parts of a double wall manway assembly according to the invention.
Figure 12:
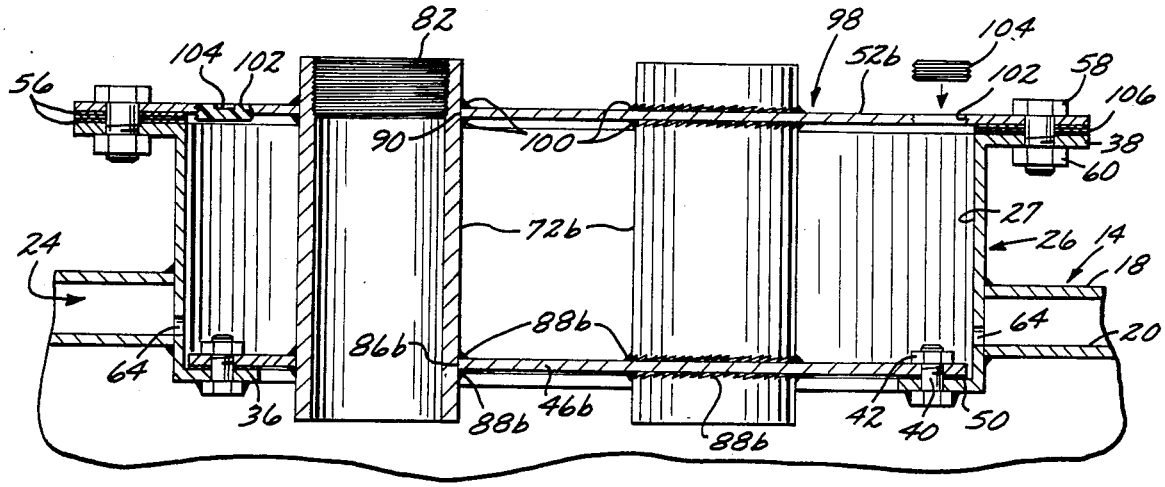
FIG. 12 is an axial, vertical section, partly in elevation, similar to FIG. 10, taken on the line 12—12 in FIG. 11.

FIGS. 11 and 12 illustrate a third embodiment of the invention wherein double wall manway assembly 98 also embodies as a structural part thereof three regularly spaced pipe fittings, in this case pipe fittings 72*b* which are the same as pipe fittings 72 shown in FIG. 7, with internal threads 82, but without the external threading of the pipe fittings in FIGS. 9 and 10.

Double wall manway assembly 98 of FIGS. 11 and 12 has respective inner and outer cover disks 46*b* and 52*b*. The three pipe fittings 72*b* extend through respective apertures 86*b* through inner cover 46*b*, and are welded and sealed to inner cover 46*b* by inner and outer annular welds 88*b*. The upper end portions of pipe fittings 72*b* extend through respective apertures 90 in outer cover 52*b*, and are structurally and sealingly secured to outer cover 52*b* proximate apertures 90 by inner and outer annular welds 100.

Welds 88*b* and 100 secure pipe fittings 72*b* to respective inner and outer covers 46*b* and 52*b* such that double wall manway assembly 98 constitutes a rigid, integral structural unit. The respective inner and outer covers 46*b* and 52*b* are relatively arranged in this structural unit such that when inner cover stud holes 48 register with inner flange studs 40, outer cover bolt holes 54 will register with outer flange bolt holes 44. As with the two forms of the invention previously described, studs and stud nuts may be employed in place of outer bolts 48 and nuts 60.

Since the double wall manway 98 of FIGS. 11 and 12 is a unitary structure, inner stud nuts 42 cannot be engaged and tightened onto inner flange studs 40 with the outer cover removed. Accordingly, an annular array of nut access holes 102 is provided through outer cover 52*b*, these nut access holes 102 being vertically aligned or in registry with inner cover stud holes 48, and hence inner flange studs 40 extending upwardly through stud holes 48. Nuts captively held in a socket wrench are lowered through respective nut access holes 102 and threadedly engaged and tightened onto the respective inner flange studs 40. At the same time, respective inner and outer sealing gaskets 50 and 56 are in place on the respective inner and outer flanges 36 and 38. After inner stud nuts 42 have been tightened, all of the nut access holes 102 are closed with respective plugs 104. Plugs 104 are shown as threaded pipe plugs, which are preferred because they are easy to seal and can be made to fit flush with the upper surface of outer cover 52*b*. However, it is to be understood that plugs 104 could alternatively be snap-in-type plastic plugs.

It is to be noted that the integral assembly of inner and outer cover disks 46*b* and 52*b* and pipe fittings 72*b* would require rather close manufacturing tolerances to assure good sealing at the respective inner and outer flanges 36 and 38 without the availability of some compensation means. Such compensation is automatically achieved in the form of the invention shown in FIGS. 9 and 10. A way of achieving such tolerance compensation in the form shown in FIGS. 11 and 12 is to provide one or more shims in either inner sealing gasket 50 or outer sealing gasket 56. By way of illustration, a flat annular shim 106, which may be made of metal, plastic, or a fiber/plastic material, is shown embedded in the middle of outer sealing gasket 56.

Figure 13:
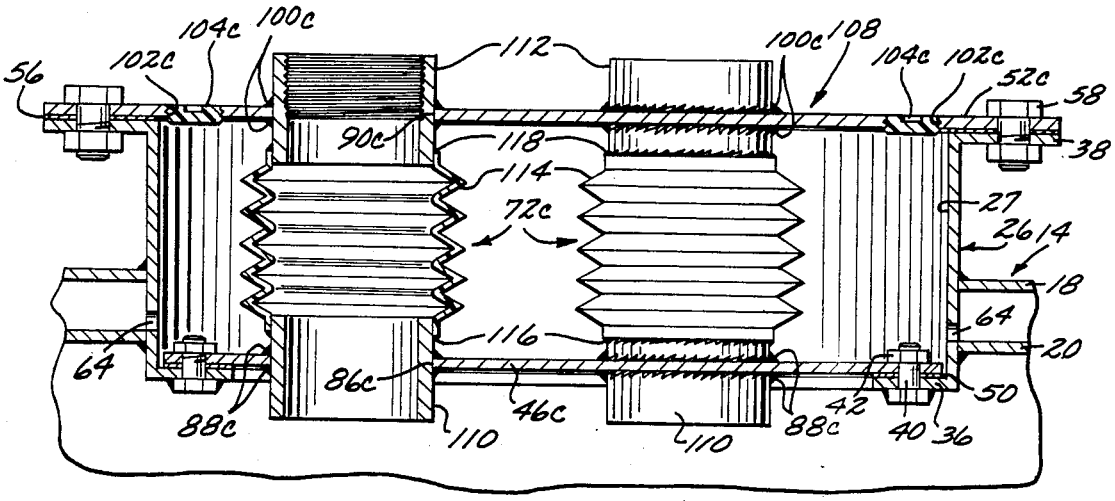
FIG. 13 is an axial, vertical sectional view, partly in elevation, similar to FIGS. 10 and 12, illustrating yet another form of double wall manway assembly embodying pipe fittings as structural parts thereof.

FIG. 13 illustrates a fourth embodiment of the invention wherein automatic compensation is provided for the spacing between the inner and outer cover disks to assure optimum sealing engagement thereof with the respective inner and outer riser flanges. The double wall manway assembly shown in FIG. 13 is generally designated 108, and consists of respective inner and outer cover disks 46*c* and 52*c* through which three regularly spaced pipe fittings 72*c* extend and to which pipe fittings 72*c* are integrally attached, as by welding. Pipe fittings 72*c* are bellows-type fittings to provide the automatic spacing adjustment between cover disks 46*c* and 52*c* to accomodate the built-in spacing between respective riser flanges 36 and 38. Rigid lower and upper end sections 110 and 112 of pipe fittings 72*c* extend through respective apertures 86*c* and 90*c* in respective lower and upper covers 46*c* and 52*c*, and are welded and sealed to covers 46*c* and 52*c* by respective annular welds 88*c* and 100*c*. Lower and upper end sections 110 and 112 are of conventional straight cylindrical pipe, the upper end sections of the three fittings 72*c* being internally threaded.

Extending between lower end section 110 and upper end section 112 of each fitting 72*c* is an intermediate bellows section 114 which has a lower end attached to and sealed with the respective lower end section 110 by an annular weld 116, and an upper end attached to and sealed with the respective upper end section 112 by an annular weld 118. The automatic spacing compensation between lower and upper covers 46c and 52c provided by bellows sections 114 of fittings 72c eliminates any possible need for one or more shims as might be required in the form of the invention shown in FIGS. 11 and 12.

Since the combination of inner and outer covers 46c and 52c with the bellows-type pipe fittings 72c is a unitary structural combination similar to that of the form of the invention shown in FIGS. 11 and 12, an annular array of nut access holes 102c is provided through upper cover 52c in registry with inner cover stud holes 48 to allow placement and tightening of stud nuts 42 on inner flange studs 40, after which nut access holes 102c are closed with respective plugs 104c.

As with the other forms of the invention, studs and stud nuts may alternatively be employed in place of outer cover fastening bolts 58 and nuts 60.

While the present invention has been described with reference to presently preferred embodiments, it is to be understood that various modifications or alterations may be made by those skilled in the art without departing from the scope and spirit of the invention as set forth in the appended claims.

I claim:

1. In a double wall tank having an inner wall defining an inner primary chamber for primary fluid containment and an outer wall which, together with said inner wall, defines an outer secondary chamber for secondary fluid containment, a tank manway assembly which comprises:

tubular riser means having inner and outer ends rigidly mounted in apertures through both of said inner and outer tank walls so as to provide communication between the outside of said outer tank wall and said inner primary chamber;

inner flange means on said riser means defining a first outwardly facing seat extending substantially continuously about the periphery of said riser means;

outer flange means on said riser means defining a second outwardly facing seat extending substantially continuously about the periphery of said riser means;

an inner cover member peripherally engageable over said first seat, and first securing means for securing said inner cover member to said inner flange; and an outer cover member peripherally engageable over said second seat in outwardly spaced relationship to said inner cover member, and second securing means for securing said outer cover member to said outer flange means.

2. A tank manway assembly as defined in claim 1, wherein said riser means is substantially a circular cylinder, and said inner and outer flange means and said inner and outer cover members are substantially circular.

3. A tank manway assembly as defined in claim 1, wherein said inner and outer flange means are each substantially flat.

4. A tank manway assembly as defined in claim 3, wherein said inner and outer flange means are substantially parallel to each other.

5. A tank manway assembly as defined in claim 1, wherein said outer flange means is located outside of said outer tank wall and said inner flange means is spaced inwardly from said outer tank wall.

6. A tank manway assembly as defined in claim 5, comprising vent passage means extending through the wall of said riser means so as to provide communication from the inside of said riser means between said inner and outer cover members to said outer secondary tank chamber.

7. A tank manway assembly as defined in claim 1, wherein said outer flange means is located outside of said outer tank wall and said inner flange means is located inwardly of said inner tank wall.

8. A tank manway assembly as defined in claim 7, comprising vent passage means extending through the wall of said riser means so as to provide communication from the inside of said riser means between said inner and outer cover members to said outer secondary tank chamber.

9. A tank manway assembly as defined in claim 5, which comprises fluid sealing means between said inner flange means and said inner cover member.

10. A tank manway assembly as defined in claim 6, which comprises fluid sealing means between said inner flange means and said inner cover member.

11. A tank manway assembly as defined in claim 10, which comprises fluid sealing means between said outer flange means and said outer cover member.

12. A tank manway assembly as defined in claim 1, which comprises pipe fitting means extending through both of said inner and outer cover members so as to provide communication between the outside of said outer tank wall and said inner primary tank chamber, said pipe fitting means being rigidly connected to at least one of said inner and outer cover members.

13. A tank manway assembly as defined in claim 12, wherein said pipe fitting means is rigidly secured to at least said inner cover member.

14. A tank manway assembly as defined in claim 12, wherein said pipe fitting means comprises three pipe fittings.

15. A tank manway assembly as defined in claim 12, wherein said fitting means is rigidly connected to said inner cover member, and is slideably engaged through said outer cover member; and nut means threadedly engaged over said fitting means outside of said outer cover member and adapted to apply inward clamping force to the outside of said outer cover member.

16. A tank manway assembly as defined in claim 12, wherein said fitting means is rigidly connected to each of said inner and outer cover members.

17. A tank manway assembly as defined in claim 16, which comprises shim means between at least one of said flange means and its respective said cover member to adjust for manufacturing tolerance in the spacing between said cover members provided by said rigid connections relative to the spacing between said inner and outer flange means.

18. A tank manway assembly as defined in claim 16, wherein said fitting means comprises rigid inner pipe end means rigidly connected to said inner cover member, rigid outer pipe end means rigidly connected to said outer cover member, and bellows means located between said inner and outer cover members and rigidly connected to and extending between said inner and outer pipe end means.

19. A tank manway assembly as defined in claim 12, wherein said outer flange means is located outside of said outer tank wall and said inner flange means is spaced inwardly from said outer tank wall; and comprising vent passage means extending through the wall of said riser means so as to provide communication from the inside of said riser means between said inner and outer cover members to said outer secondary tank chamber.

20. A tank manway assembly as defined in claim 19, wherein said inner flange means is located inwardly of said inner tank wall.

* * * * *